US005924651A

United States Patent [19]

Penza et al.

[11] Patent Number: 5,924,651

[45] **Date of Patent: *Jul. 20, 1999**

[54] TACTILE AND AUDIBLE WARNING SYSTEM FOR RAILROAD WORKERS

[76] Inventors: George Gregory Penza, 42 Valentine Ave., Huntington, N.Y. 11743; George Robert Penza, 4 E. Gate La., Old Field, N.Y. 11733

[ * ] Notice: This patent is subject to a terminal disclaimer.

[21] Appl. No.: 09/042,886

[22] Filed: Mar. 17, 1998

Related U.S. Application Data

[63] Continuation-in-part of application No. 08/827,346, Mar. 26, 1997, Pat. No. 5,727,758.

[51] Int. Cl.[6] ..... B61L 1/00

[52] U.S. Cl. ..... 246/124; 246/293; 246/294; 246/477

[58] Field of Search ..... 246/122 R, 124, 246/167 D, 270 R, 294, 295, 477, 488, 293; 340/902

[56] References Cited

U.S. PATENT DOCUMENTS

| | | | |
|---|---|---|---|
| 2,762,913 | 9/1956 | Jepson . | |
| 3,167,282 | 1/1965 | Hursh et al. | 246/124 |
| 5,265,831 | 11/1993 | Muller | 246/124 |
| 5,303,259 | 4/1994 | Loveall . | |
| 5,415,369 | 5/1995 | Hungate . | |
| 5,461,366 | 10/1995 | Figuereo et al. . | |
| 5,554,982 | 9/1996 | Shirkey et al. . | |
| 5,572,201 | 11/1996 | Graham et al. . | |
| 5,620,155 | 4/1997 | Michalek . | |
| 5,727,758 | 3/1998 | Penza et al. | 246/124 |
| 5,735,491 | 4/1998 | Atkinson | 246/124 |

FOREIGN PATENT DOCUMENTS

| | | | |
|---|---|---|---|
| 2233667 | 6/1973 | France | 246/167 A |
| 2405408 | 8/1975 | Germany . | |
| 4219067A1 | 12/1993 | Germany . | |
| 52-35504 | 3/1977 | Japan . | |
| 63-315369 | 12/1988 | Japan . | |
| 4-39159 | 2/1992 | Japan | 246/167 A |
| 4-126664 | 4/1992 | Japan . | |
| 4-163273 | 6/1992 | Japan . | |
| 6-1239 | 1/1994 | Japan . | |
| 6-183346 | 7/1994 | Japan | 246/167 A |
| 374214 | 6/1973 | U.S.S.R. . | |
| 92/04699 | 3/1992 | WIPO | 246/167 A |
| WO94/21504 | 9/1994 | WIPO . | |

*Primary Examiner*—Mark T. Le
*Attorney, Agent, or Firm*—Brooks & Kushman, P.C.

[57] ABSTRACT

A train warning system and method for warning personnel in proximity to railroad tracks of an approaching train includes a train sensor operable with the railroad tracks for detecting passage of a train over the railroad tracks at a given location. The train sensor generates a train sensor signal upon detecting passage of a train over the railroad tracks at the given location. A transmitter is operable with the train sensor for transmitting a warning signal upon receipt of the train sensor signal. A portable radio frequency (RF) receiver is carried by at least one of the personnel in proximity to the railroad tracks remote from the railroad tracks at the given location for receiving the warning signal transmitted by the transmitter. The portable RF receiver generates an alarm signal to notify the at least one of the personnel of the approaching train upon receipt of the warning signal.

20 Claims, 4 Drawing Sheets

TACTILE AND AUDIBLE WARNING SYSTEM FOR RAILROAD WORKERS

CROSS-REFERENCE TO RELATED APPLICATIONS

This patent application is a continuation-in-part of Ser. No. 08/827,346 now U.S Pat. No. 5,727,758, entitled Tactile and Audible Warning System for Railroad Workers, filed on Mar. 26, 1997.

TECHNICAL FIELD

The present invention relates to railway switches and signals and, more particularly, to a system and method for warning personnel in proximity to railroad tracks of an approaching train.

BACKGROUND ART

Railroad personnel working in proximity to railroad tracks need to be aware of approaching incoming trains. One way to warn personnel is to designate a person as a lookout or flagperson. The responsibility of the lookout is to watch for incoming trains. Upon seeing an incoming train the lookout warns the other personnel adjacent the railroad track of the approaching train. The lookout may warn the others by verbal communication such as talking or yelling.

Another approach to warning the personnel is to have a person act as a railroad track walker. The responsibility of the track walker is to walk along the railroad tracks between railroad stations and look for incoming trains. Upon seeing an incoming train, the track walker warns the others by verbal communication. the distance between the track walker and the others is too far for verbal communication, the track walker may be provided with a Radio Frequency (RF) transmitter and transmit a verbal warning signal to a designated person having an RF receiver for receiving the verbal warning. Upon hearing the verbal warning from the track walker via the RF receiver, the designated receiver person warns the others by verbal communication.

A primary disadvantage associated with the above identified approaches is that, at times, the lookout personnel may become distracted. As a result of being distracted, the lookout personnel and the other personnel in proximity to the railroad track may be at risk.

Another primary disadvantage associated with the above identified approaches is that sometimes heavy machinery such as a crane may be being used for working adjacent the railroad tracks. A part of the machinery may intrude over the space above the railroad tracks. Accordingly, the machinery has to be moved to avoid a collision with the incoming train. In these situations, the machine operators need to be provided with a warning ample time ahead of the arrival of the train to be able to move the machinery. However, if the operator is working in a cab in the machinery it may be difficult to communicate with the operator. Valuable time may be lost in attempting to get the attention of the operator.

U.S. Pat. No. 5,415,369 discloses a railroad in-cab signaling system for providing enhanced communication between a train and a railroad signal. The train has an RF transceiver for communicating with an RF transceiver provided with the railroad signal. As disclosed, this patent does not address warning personnel in proximity to railroad tracks of an approaching train.

Japanese Patent 4-126664 (A) discloses a railroad communication system. A track supervisor receives an RF train passage signal and then subsequently transmits an RF alarm signal to an alarm receiver carried by each worker. The alarm receiver checks the alarm signal to determine whether the alarm signal has been sent to its own station.

Japanese Kokai No. 52-35504 discloses a railroad safety system for informing train passengers on a platform of an incoming train. A detector on the railroad tracks generates an audible alarm signal at the platform when a train passes over the detector. Although this application describes a system for warning passengers or personnel of an incoming train, a more direct and a quieter way is needed to warn personnel in proximity to railroad tracks of an approaching incoming train. Among other things, a quieter way needs to be provided which does not intrude upon the tranquility of the area around the railroad tracks such as a residential neighborhood.

SUMMARY OF THE INVENTION

Accordingly, it is an object of the present invention to provide a system and method for warning personnel in proximity to railroad tracks of an approaching train.

It is another object of the present invention to provide a system and method using a portable Radio Frequency (RF) receiver carried by at least one of the personnel in proximity to railroad tracks for receiving a warning signal transmitted by a transmitter on an approaching train.

It is still another object of the present invention to provide a system and method having the capability of providing a warning to personnel in proximity to railroad tracks a predetermined amount of time ahead of the arrival of an approaching train.

It is still yet another object of the present invention to provide a system and method using a transmitter on an approaching train for continuously transmitting a warning signal announcing the impending arrival of the train to receivers tuned for receiving the warning signal.

It is a further object of the present invention to provide a system and method using a transmitter for transmitting a warning signal in response to a train sensor detecting passage of a train over the railroad tracks at a given location.

In carrying out the above objects, the present invention provides a train warning system for warning personnel in proximity to railroad tracks of an approaching train. The system includes a train sensor operable with the railroad tracks for detecting passage of a train over the railroad tracks at a given location. The train sensor generates a train sensor signal upon detecting passage of a train over the railroad tracks at the given location. A transmitter is operable with the train sensor for transmitting a warning signal upon receipt of the train sensor signal. The system further includes a portable radio frequency (RF) receiver carried by at least one of the personnel in proximity to the railroad tracks remote from the railroad tracks at the given location for receiving the warning signal transmitted by the transmitter. The portable RF receiver generates an alarm to notify the at least one of the personnel of the approaching train upon receipt of the warning signal.

Further, in carrying out the above objects, the present invention provides a method for warning personnel in proximity to railroad tracks of an approaching train. The method includes detecting passage of a train over the railroad tracks at a given location with a train sensor. A train sensor signal is then generated upon detecting passage of a train over the railroad tracks at the given location. A warning signal from a transmitter operable with the train sensor is then transmitted upon receipt of the train sensor signal by the transmitter. The warning signal from the transmitter is then received with a portable radio frequency (RF) receiver carried by at least one of the personnel in proximity to the railroad tracks remote from the railroad tracks at the given location. An alarm is then generated to notify the at least one of the personnel of the approaching train upon receipt of the warning signal by the portable RF receiver.

The advantages accruing to the present invention are numerous. All railroad personnel having the portable RF receivers will be warned of an approaching train. Accordingly, the personnel do not need to rely on a designated lookout possibly susceptible to distractions. Furthermore, the personnel may be warned a predetermined amount of time ahead of the arrival of the train so that the personnel have enough time to clear the railroad track.

These and other features, aspects, and embodiments of the present invention will become better understood with regard to the following description, appended claims, and accompanying drawings.

BEST MODES FOR CARRYING OUT THE INVENTION

Figure 1:
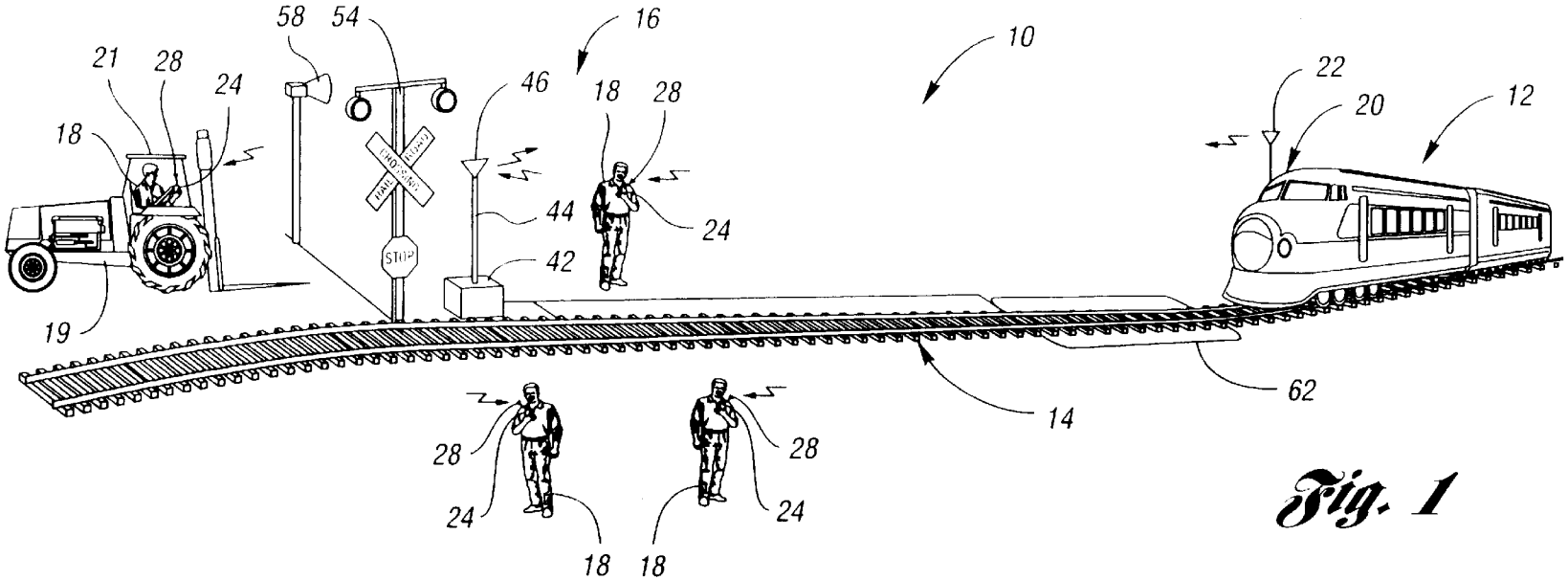
FIG. 1 is a schematic representation of a train warning system in accordance with a first embodiment of the present invention for warning personnel in proximity to railroad tracks of an approaching train.
Figure 2:
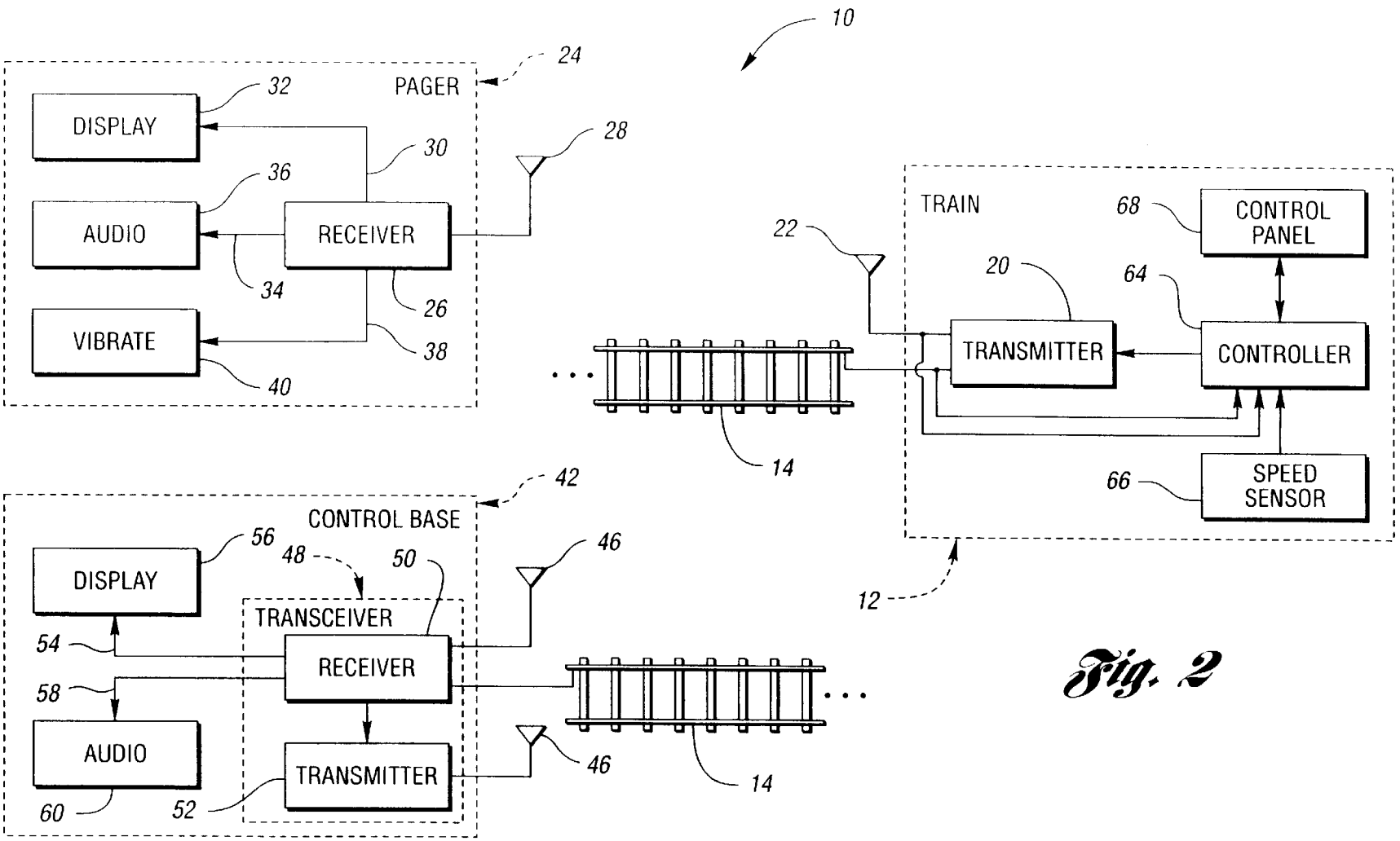
FIG. 2 is a block diagram of the warning system shown in FIG. 1.

Referring now to FIGS. 1 and 2, a personal train warning system 10 in accordance with a first embodiment of the present invention is shown. System 10 includes a train 12 riding on railroad tracks 14. Tracks 14 pass through a railroad station 16. Adjacent station 16, railroad personnel 18 carry out their various railroad responsibilities. As examples of the various railroad responsibilities being performed, personnel 18 may be performing construction tasks with machinery such as back hoes, drills, jack hammers, or the like. Personnel 18 may also be performing heavy construction tasks with heavy machinery such as crane 19. Personnel 18 may further be performing other tasks such as switching the railroad tracks to change the course of train 12 as it passes through station 16.

Because of the various activities performed by personnel 18, some of the personnel may be unaware of an approaching train. For instance, a back hoe operator may be unable to hear the sound of an approaching train or the verbal warnings of a flagperson. As another example, a heavy machinery operator working in an operator cab 21 may have trouble hearing verbal warnings from personnel standing on the ground near the machine. Of course, many of the personnel may be performing tasks in which they never look in the direction of an approaching train while performing the tasks.

Obviously, personnel 18 need to be aware of an approaching incoming train. System 10 provides for enhanced communication between train 12 and personnel 18 so that all of the personnel are aware of an approaching train without having to actually hear or see the train, feel the train approaching, or rely on others for verbal warnings. To this end, train 12 includes a train transmitter 20 for transmitting a warning signal to warn of the impending arrival of an approaching train.

In a preferred embodiment, transmitter 20 is coupled to a transmitter antenna 22 which preferably extends out over train 12. Transmitter 20 transmits a radio frequency (RF) warning signal from antenna 22 continuously during the operation of train 12. The RF warning signal preferably has a carrier frequency in the range of 900 MHz to 980 MHz which includes the designated beeper or pager frequencies. Of course, transmitter 20 may be configured to transmit at any available frequency used for electronic communication. Transmitter 20 is preferably a variable output transmitter and transmits the warning signal at a given power output.

Personnel 18 each carry a portable paging device or pager 24 for receiving the RF warning signal from antenna 22 along a wireless RF transmission path. Pager 24 includes an RF receiver 26 tuned to the carrier frequency of the RF warning signal and a receiver antenna 28 for reception of the signal. Upon receipt and processing of the RF warning signal, receiver 26 actuates an alarm signal. The alarm signal notifies the person carrying pager 24 that the RF warning signal from an approaching train has been detected and that the train will be shortly approaching along railroad tracks 14.

The alarm signal may take on a variety of forms. For instance, receiver 26 may generate an output signal 30 for actuating a visual display 32. Visual display 32 may include flashing lights, alphanumeric messages, or the like. Receiver 26 may also generate an output signal 34 for actuating an audio alarm 36. Audio alarm 36 may include a beeping signal, a tone signal, or the like. Receiver 26 may further generate an output signal 38 for actuating a vibrative alarm 40. Vibrative alarm 40 causes pager 24 to vibrate to alert the pager user to check the pager. Pager 24 may be configured to actuate any combination of the alarm signals to notify the pager user of an approaching train.

In addition to or instead of personnel 18 carrying pagers 24, system 10 may also include a control base 42 at railroad station 16. Control base 42 is provided with a tower 44 for supporting an antenna 46. Antenna 46 is tuned to receive RF warning signals emanating from train antenna 22. Antenna 46 is preferably mounted on tower 44 to avoid obstructions which may interfere with the reception of the RF warning signals.

Antenna 46 is coupled to a transceiver 48 in control base 42. Transceiver 48 includes a receiver 50 and a transmitter 52. Receiver 50 is tuned to receive the RF warning signal from train 12. Upon receipt of the RF warning signal by antenna 46, receiver 50 process the RF warning signal and actuates a control base alarm signal. The control base alarm signal notifies all personnel in the vicinity of control base 42 that the RF warning signal has been detected and that the train will shortly be approaching the control base.

The control base alarm signal may take on a variety of forms. For instance, receiver 50 may generate an output signal 54 for actuating a visual display 56 such as flashing lights. As a result, those personnel within sight of visual display 56 may be warned of an approaching train. Receiver 50 may also generate an output signal 58 for actuating an audio alarm 60 such as a siren. Accordingly, those personnel which can hear audio alarm 60 may be warned of an approaching train. Control base 42 may be configured to actuate any combination of the alarm signals to notify personnel 18 of an approaching train.

Transmitter 52 of control base 42 is coupled to receiver 50 for retransmitting the received RF warning signals along a wireless RF transmission path from antenna 46 to pager 24. Thus, if pager 24 is unable to detect the RF warning signal transmitted by train transmitter 20 because of obstructions, the pager may still receive the RF warning signal from control base 42 which usually has a much less obstructed RF transmission path with the train transmitter.

As described, control base 42 may be provided along with individual pager 24 to provide an additional level of warning. Control base 42 may be used alone to warn personnel 18. Preferably, pager 24 is included in system 10 for warning personnel 18 and control base 42 is added to the desired.

According to the present invention as described, an RF warning signal is transmitted from a train along an RF transmission path to a pager. Various known techniques in the radio and paging art, such as digital and analog communication, may be employed to make the connection. For instance, train transmitter 20 may simply transmit a single carrier frequency. Train transmitter 20 may also be a Frequency Modulated (FM) transmitter to modulate an information signal with a carrier signal. Train transmitter 20 may include an encoder for encoding a coded signal into the RF warning signal. In turn, pager 24 may include a decoder for decoding the RF warning signal to extract the coded signal before activating an alarm. If the coded signal is not included with the RF warning signal, then pager 24 is configured to not activate an alarm. Accordingly, pager 24 is not susceptible to premature alarm activation due to outside RF interference or illegal RF transmission.

In an alternative embodiment, train transmitter 20 is coupled to railroad tracks 14 and transmits a warning signal directly to the railroad tracks. Receiver 50 of control base 42 is also coupled to railroad tracks 14 for receiving the warning signal from the tracks. Upon receiving and processing the warning signal, receiver 50 transmits the signal to transmitter 52 for transmission from antenna 46. Transmitter 52 transmits an RF warning signal to pager 24 along an RF transmission path. Thus, personnel 18 carrying pagers 24 are notified of an approaching train. As before, receiver 50 may activate visual display 56 or audio alarm 60 in addition to, or instead of, transmitter 52 transmitting an RF warning signal from antenna 46 to pager 24.

In another alternative embodiment, train transmitter 20 is coupled to a loop 62 buried underneath railroad tracks 14, and transmits a warning signal to the loop. Receiver 50 of control base 42 is also coupled to loop 62 for receiving the warning signal from the loop. Consequently, transmitter 52 may transmit an RF warning signal to pager 24.

Figure 3:
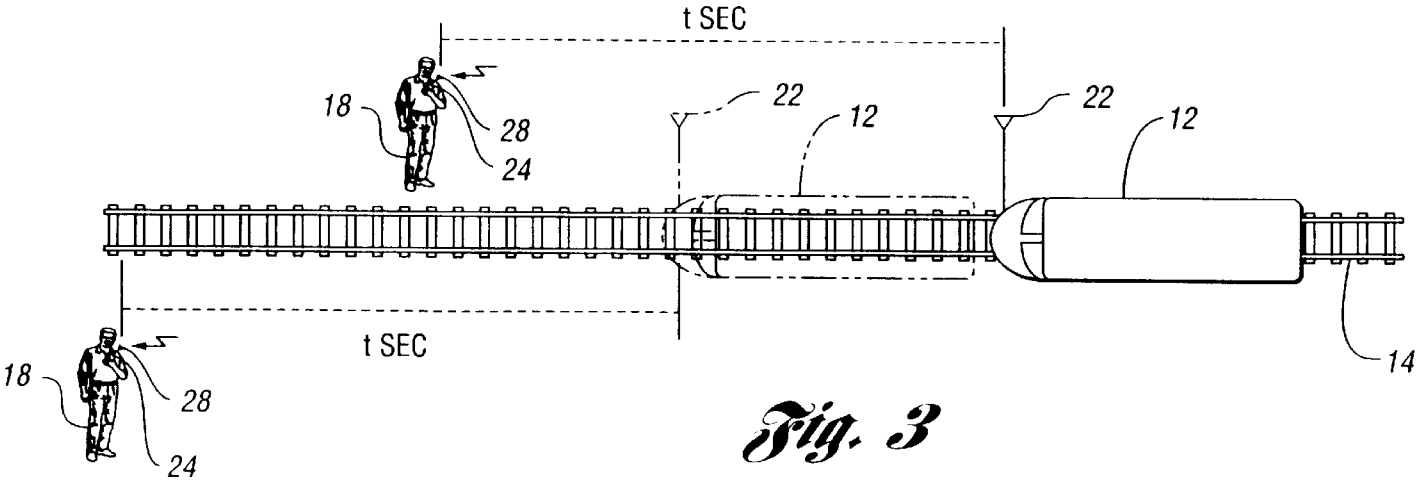
FIG. 3 is an illustration showing personnel being warned of an incoming train a predetermined amount of time ahead of the arrival of a train.

Referring now to FIGS. 2 and 3, an advantage of the present invention is that system 10 may be configured so that personnel 18 are warned a predetermined amount of time prior to the moment train 12 reaches the personnel. For example, the predetermined amount of time may be fifteen seconds. Accordingly, upon pager 24 receiving a warning signal, personnel 18 have fifteen seconds to clear railroad track 14.

To provide a constant warning time independent of the speed of train 12, a controller 64 and a speed sensor 66 are provided on the train. Controller 64 is coupled to transmitter 20 to vary the power output of the transmitted warning signal. Speed sensor 66 provides a speed signal indicative of the speed of the train. Controller 64 receives the speed signal and varies the power output of transmitter 20 as a function of the speed of train 12. As known to those skilled in the art, an RF signal having more power is able to reach a farther destination along an RF transmission path than an RF signal having less power. Similarly, a signal having more power is able to reach a further destination along a transmission line such as a railroad track than a signal having less power.

Thus, if train 12 is traveling at a high rate of speed, controller 64 controls the power output of transmitter 20 to output high power so that the far destinations from the train receive the warning signal. Accordingly, personnel 18 in these remote locations may clear railroad track 14 before train 20 rumbles through. Similarly, if train 12 is traveling at a low rate of speed, controller 64 controls the power output of transmitter 20 to output low power so that the far destinations from the train do not receive the warning signal too early. If the warning signal is received too early, personnel 18 may wait an intolerable long time after clearing railroad track 14 before train 20 trickles through.

Of course, there are many other ways of warning personnel 18 of the impending arrival of train 12. For instance, transmitter 20 may emit a warning signal having a constant power output. The warning signal may consist of a carrier signal and an information signal. The carrier signal has a constant high frequency component while the information signal has a variable frequency component. The variable frequency component of the information signal varies as a function of the speed of train 12. Thus, controller 64 receives the speed signal from speed sensor 66 to vary the frequency of the information signal. After receiving the warning signal and extracting the information signal therefrom, pager 24 may generate an alarm having an intensity which varies as a function of the frequency of the information signal. Thus, a more intense alarm signifies that train 12 has a high speed and is rapidly approaching. Conversely, a less intense alarm signifies that train 12 has a low speed and is slowly approaching.

Controller 64 may also receive a portion of the transmitted warning signal as feedback from transmitter 20. Controller 64 may process the warning portion feedback signal to ensure that transmitter 20 is functioning properly. Controller 64 may be coupled to a control panel 68 for providing information to a train operator on whether transmitter 20 is transmitting a warning signal. Controller 64 may also be configured with control panel 68 to disable the operation of train 12 if transmitter 20 is not functioning properly so that the warning system of the present invention may not be avoided.

Figure 4:
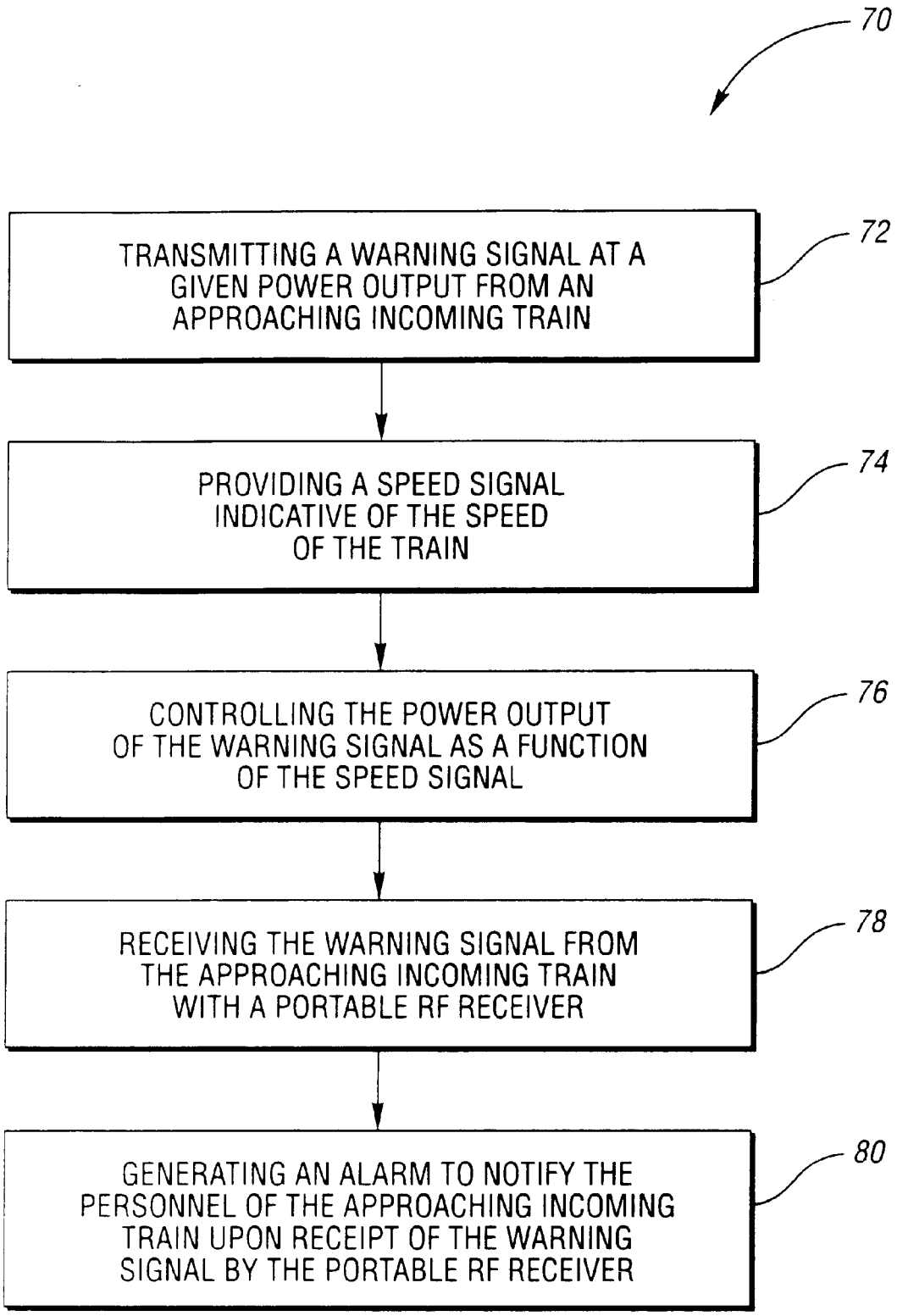
FIG. 4 is a flow diagram representing operation of a personal train warning system and method in accordance with a first embodiment of the present invention.

Referring now to FIG. 4, a flow diagram 70 representing operation of an early warning system and method in accordance with a first embodiment of the present invention is shown. In general, flow diagram 70 warns personnel in proximity to railroad tracks of an approaching train. Flow diagram 70 begins with block 72 transmitting a warning signal at a given power output from an approaching train. The warning signal is transmitted continuously during operation of the train. Block 74 then provides a speed signal indicative of the speed of the train. Block 76 then controls the power output of the warning signal as a function of the speed signal.

Block 78 then receives the warning signal from the approaching train with a portable RF receiver. The portable RF receiver is carried by at least one of the personnel in proximity to the railroad tracks. Block 80 then generates an alarm to notify the at least one of the personnel of the approaching train upon receipt of the warning signal by the portable RF receiver. The at least one of the personnel may then clear the railroad track.

Figure 5:
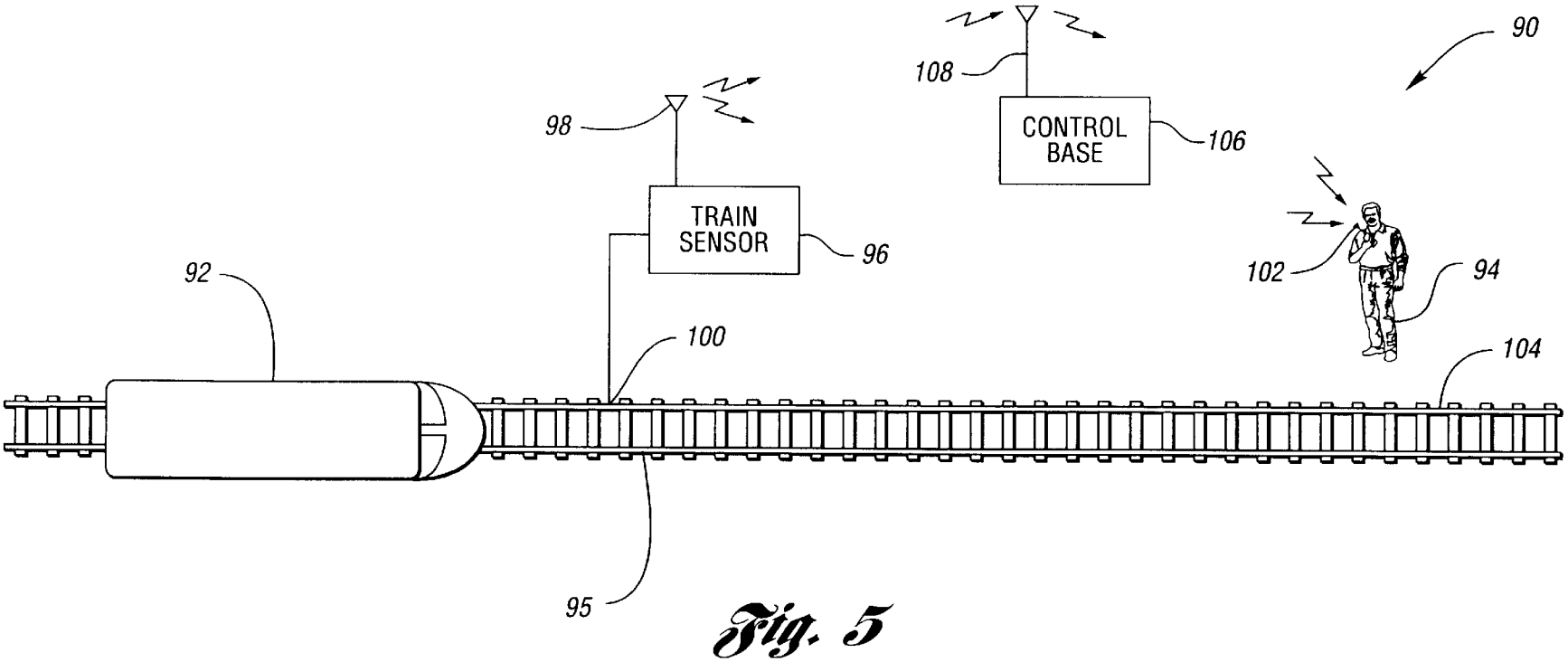
FIG. 5 is a schematic representation of a train warning system in accordance with a second embodiment of the present invention for warning personnel in proximity to railroad tracks of an approaching train.

Referring now to FIG. 5, a train warning system 90 in accordance with a second embodiment of the present invention is shown. System 90 includes a train 92 riding on railroad tracks 94. Railroad personnel 94 carry out their various railroad responsibilities along railroad track 95. System 90 further includes a train sensor 96 provided with an RF transmitter 98. Train sensor 96 detects passage of train 92 over the railroad tracks at the given location.

Train sensor 96 may be any device as known to those skilled in the art for detecting train passage over railroad tracks such as a pressure transducer mounted to railroad tracks 95 at given location 100. Train sensor 96 may also be a part of a global positioning system operable with train 92 to determine the position of the train and when the train passes over given location 100. Train sensor 96 generates a train sensor signal upon detecting passage of train 92 over railroad tracks 95 at given location 100.

Transmitter 98 is operable with train sensor 96 for transmitting a warning signal upon receipt of the train sensor signal from the train sensor. Preferably, the warning signal is transmitted along a wireless RF path.

Personnel 94 carry a pager 102 for receiving the RF warning signal from transmitter 98 along the wireless RF transmission path. Personnel 94 are in proximity to railroad tracks 95 at a given location 104 remote from the railroad tracks at given location 100. Upon receipt and processing of the RF warning signal, pager 102 actuates an alarm signal. The alarm signal notifies personnel 94 that train 92 has been detected at given location 100 and that the train will be shortly approaching the personnel at given location 104.

System 90 may further include a control base 106 such as a satellite having a transceiver 108 for receiving the warning signal from transmitter 98. Upon receipt of the warning signal, transceiver 108 retransmits the warning signal to pager 102 along a wireless RF transmission path. Control base 106 may also generate an alarm upon receipt of the warning signal to notify the personnel in proximity to the control base that train 92 has been detected at given location 100.

To ensure that system 90 is functioning properly, transmitter 98 may transmit status signals at predetermined time intervals to pager 102. The status signals are used to enable pager 102 to validate proper functioning of transmitter 98 and the pager. Pager 102 generates an alarm signal when the pager has not received a status signal from transmitter 98 at the predetermined time interval. This alarm signal notifies personnel 102 that a status signal has not been received which indicates that transmitter 98 or pager 102 is not functioning properly. Control base 106 may also receive the status signals from transmitter 98 and then retransmit them to pager 102.

With reference to FIG. 1, transmitter 98 and control base 106 may be coupled to a loop buried underneath railroad tracks 95 or to the railroad tracks themselves to allow the control base to receive the warning signal from the transmitter.

Thus it is apparent that there has been provided, in accordance with the present invention, a train warning system and method that fully satisfy the objects, aims, and advantages set forth above. While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A train warning system for warning personnel in proximity to railroad tracks of an approaching train, the system comprising:

a train sensor operable with the railroad tracks for detecting passage of a train over the railroad tracks at a given location, wherein the train sensor generates a a train sensor signal upon detecting passage of a train over the railroad tracks at the given location;

a transmitter disposed on the train and operable with the train sensor for transmitting a warning signal upon receipt of the train sensor signal; and a portable radio frequency (RF) receiver carried by at least one of the personnel in proximity to the railroad tracks remote from the railroad tracks at the given location for receiving the warning signal transmitted by the transmitter, whereupon receiving the warning signal the portable RF receiver generates an alarm to notify the at least one of the personnel of the approaching train.

2. The train warning system of claim 1 wherein:

the train sensor is mounted to the railroad tracks.

3. The train warning system of claim 2 wherein:

the train sensor senses pressure on the railroad tracks at the given location to detect passage of a train.

4. The train warning system of claim 1 wherein:

the transmitter transmits the warning signal along a wireless RF transmission path.

5. The train warning system of claim 1 further comprising:

a control base having a transceiver for receiving the warning signal transmitted by the transmitter and for then transmitting the warning signal along a wireless RF transmission path to the portable RF receiver.

6. The train warning system of claim 5 wherein:

the transmitter is coupled to the railroad tracks and transmits the warning signal along the railroad tracks; and the control base transceiver is coupled to the railroad tracks for receiving the warning signal transmitted by the transmitter along the railroad tracks.

7. The train warning system of claim 5 wherein:

the transmitter transmits the warning signal along a wireless RF transmission path; and the control base transceiver receives the warning signal along the wireless RF transmission path.

8. The train warning system of claim 5 wherein:

the control base generates an alarm upon receipt of the warning signal to notify the personnel in proximity of the control base of the approaching train.

9. The train warning system of claim 1 wherein:

the alarm generated by the portable RF receiver is a visual alarm.

10. The train warning system of claim 1 wherein:

the alarm generated by the portable RF receiver is an audio alarm.

11. The train warning system of claim 1 wherein:

the alarm generated by the portable RF receiver is a vibrative alarm.

12. The train warning system of claim 1 wherein:

the transmitter transmits a status signal at predetermined time intervals to enable the portable RF receiver to validate proper functioning of the transmitter and the portable RF receiver.

13. The train warning system of claim 12 wherein:

the portable RF receiver generates an alarm signal when the portable RF receiver has not received a status signal from the transmitter at the predetermined time interval.

14. The train warning system of claim 12 further comprising:

a control base having a transceiver for receiving the status signal transmitted by the transmitter and for then transmitting the status signal along a wireless RF transmission path to the portable RF receiver, wherein the portable RF receiver generates an alarm signal when the portable RF receiver has not received a status signal from the control base at the predetermined time interval.

15. A method for warning personnel in proximity to railroad tracks of an approaching train, the method comprising:

detecting passage of a train over the railroad tracks at a given location with a train sensor;

generating a train sensor signal upon detecting passage of a train over the railroad tracks at the given location;

transmitting a warning signal from a transmitter disposed on the train and operable with the train sensor upon receipt of the train sensor signal by the transmitter;

receiving the warning signal from the transmitter with a portable radio frequency (RF) receiver carried by at least one of the personnel in proximity to the railroad tracks remote from the railroad tracks at the given location; and generating an alarm to notify the at least one of the personnel of the approaching train upon receipt of the warning signal by the portable RF receiver.

16. The train warning method of claim 15 wherein:

the warning signal is transmitted along a wireless RF transmission path.

17. The train warning method of claim 15 wherein:

generating an alarm comprises generating a visual alarm.

18. The train warning method of claim 15 wherein:

generating an alarm comprises generating an audio alarm.

19. The train warning method of claim 15 wherein:

generating an alarm comprises generating a vibrative alarm.

20. The training warning method of claim 15 further comprising:

transmitting a status signal to the portable RF receiver at predetermined time intervals to enable the portable RF receiver to validate proper functioning of the transmitter and the portable RF receiver; and generating an alarm signal when a status signal is not received by the portable RF receiver.

* * * * *